US007410345B2

(12) United States Patent
Bracken

(10) Patent No.: US 7,410,345 B2
(45) Date of Patent: Aug. 12, 2008

(54) TURBINE NOZZLE RETENTION KEY

(75) Inventor: Robert James Bracken, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 666 days.

(21) Appl. No.: 11/102,729

(22) Filed: Apr. 11, 2005

(65) Prior Publication Data

US 2006/0228213 A1 Oct. 12, 2006

(51) Int. Cl.
*F01D 9/04* (2006.01)

(52) U.S. Cl. ..... 416/215; 416/204 A; 415/190

(58) Field of Classification Search ..... 29/889.22; 415/190, 191, 209.2, 209.3, 209.4, 210.1; 416/204 A, 215, 220 R See application file for complete search history.

(56) References Cited

U.S. PATENT DOCUMENTS 6,279,420 B1 * 8/2001 Knorowski et al. ..... 464/180
6,722,848 B1 * 4/2004 Couture et al. ..... 415/209.2

* cited by examiner

*Primary Examiner*—Edward Look
*Assistant Examiner*—Asefeh Hemmati
(74) *Attorney, Agent, or Firm*—Nixon & Vanderhye, PC

(57) ABSTRACT

A retaining key for a turbine nozzle includes a key body having top and bottom surfaces, a pair of sides and a pair of ends including a forward end having a pair of horizontal shoulders on opposite sides of a center rib, the shoulders located substantially midway between the top and bottom surfaces such that the forward end has a substantially inverted T-shaped profile, and a rearward end having a first surface portion extending from and substantially perpendicular to the top surface and a second surface portion extending at an acute angle downwardly and toward the forward end and intersecting the bottom surface.

16 Claims, 4 Drawing Sheets

TURBINE NOZZLE RETENTION KEY

BACKGROUND OF THE INVENTION

The present invention relates to apparatus for retaining nozzles stacked one against the other in a groove of a carrier of a turbine. The invention particularly relates to a new nozzle retention key for retaining the nozzles in carrier grooves at the horizontal joint faces between upper and lower carrier halves, which does not require mechanical fastening of the key to the carrier.

In steam turbines, there is typically an annular carrier for supporting the axially spaced, circumferential arrays of fixed nozzles. The annular carrier is usually divided into a pair of carrier segments or halves, each of which extends arcuately 180°. The carrier halves are secured to one another at opposed horizontal joint faces to form a 360° array of nozzles at each axially spaced turbine stage position. Typically, the nozzles comprise an airfoil having a radial outer dovetail-shaped base for reception in a generally correspondingly dovetail-shaped groove in the carrier. Generally, the opposite side faces of each base of the respective nozzles are angled relative to the axis of the turbine, enabling the base to accommodate the angularity of the airfoil. When the nozzles are installed in each carrier half groove, the nozzle bases are stacked one against the other within the grooves forming a semi-circular array of nozzles.

The first nozzles loaded into a carrier, especially the carrier upper half, require a retention key to prevent the first and subsequently added nozzles from falling out of the dovetail during assembly. This same problem can also surface in connection with both the upper and lower carrier halves during disassembly or shipping of the carrier segments.

One current key design requires a machined pocket in the carrier at the horizontal joint face; a tapped hole in the machined pocket; and a screw to retain the key in the pocket.

There is a need for a new key design that eliminates the screw and the need for tapping the carrier to thereby also eliminate the possibility of breaking either a tap or a screw in the carrier.

BRIEF DESCRIPTION OF THE INVENTION

In accordance with an exemplary embodiment of the present invention, there is provided a turbine nozzle retention key for retaining nozzles at the joint interface of each carrier half that eliminates the need to tap the carrier; eliminates the need to enlarge the tap in the carrier if/when the row of nozzles is serviced; eliminates two screws per stage of nozzles; potentially reduces carrier machining time by removing the tapped hole from the machined features; and potentially reduces the cost of the lug keys by removing the through hole and countersink required for a retaining screw or other fastener.

In the exemplary embodiment, a slot is machined in the carrier at one or both sides of the horizontal joint face, adjacent one or both ends of the dovetail groove. Specifically, the slot has a narrow upper slot portion, open to the joint face, with planar sides and a rounded end wall. The slot is also formed with a lower undercut portion that extends laterally beyond both sides of the upper portion and longitudinally beyond the end wall of upper portion. The side walls of the lower portion are also planar and terminate at a rounded end wall of larger radius than the rounded end wall of the upper slot portion.

The key is formed from a generally rectangular, solid block that is machined to remove material along two sides of the block to thereby form steps or shoulders on either side of a center rib of full height. These shoulders do not extend the full length of the block, and leave a rearward portion without shoulders, flush with the center rib. The rib terminates at forward facing surfaces on either side of the rib. The rearward end wall is also machined, however, to form an angled seating surface extending to the bottom of the key that is adapted to be engaged by a similarly angled surface on an adjacent nozzle dovetail.

This configuration requires the key to be inserted into the carrier slot first, before the adjacent nozzle. When the adjacent nozzle is pushed into place, engaging the angled seating surface, the key is prevented from escaping the slot, and the nozzle is retained in the carrier dovetail groove without having to otherwise secure the key to the carrier via separate fasteners such as screws or the like.

Accordingly, in one aspect, the present invention relates to a retaining key for a turbine nozzle comprising a key body having top and bottom surfaces, a pair of sides and a pair of ends including a forward end having a pair of horizontal shoulders on opposite sides of a center rib, the shoulders located substantially midway between the top and bottom surfaces such that the forward end has a substantially inverted T-shaped profile, and a rearward end having a first surface portion extending from and substantially perpendicular to the top surface and a second surface portion extending at an acute angle downwardly and toward the forward end and intersecting the bottom surface.

In another aspect, the invention relates to a turbine carrier for a steam turbine comprising a pair of 180° arcuate segments, each formed with a semi-annular groove for receiving a plurality of nozzles in side-by-side relationship, each arcuate segment having a pair of horizontally-oriented joint faces, at least one of the joint faces having a key slot formed therein, each key slot formed by a narrow upper portion open to the respective joint face and to the semi-annular groove, and a wider undercut portion below the narrow upper portion open only to the semi-annular groove.

In still another aspect, the present invention relates to a turbine carrier for a steam turbine comprising a pair of 180° arcuate segments, each formed with a semi-annular groove for receiving a plurality of nozzles in side-by-side relationship, each arcuate segment having a pair of horizontally-oriented joint faces, at least one of the joint faces having a key slot formed therein, each key slot formed by a narrow upper portion open to the respective joint face and to the semi-annular groove, and a wider undercut portion below the narrow upper portion open only to the semi-annular groove; wherein each of the semi-annular grooves comprises a female dovetail groove; and further comprising a nozzle retaining key adapted for insertion into said at least one key slot, the retaining key comprising a key body having top and bottom surfaces, a pair of sides and a pair of ends including a forward end having a pair of horizontal shoulders on opposite sides of a center rib, the shoulders located substantially midway between the top and bottom surfaces such that the forward end has a substantially inverted T-shaped profile, and a rearward end having a first surface portion extending from and substantially perpendicular to the top surface and a second surface portion extending at an acute angle downwardly and toward the forward end and intersecting the bottom surface; wherein the top surface extends uniformly across the rearward end and the center rib; and further wherein the shoulders terminate in a rearward direction at vertical, forward-facing surfaces on either side of the center rib, extending substantially perpendicular to the top and bottom surfaces.

The invention will now be described in detail in connection with the drawings identified below.

DETAILED DESCRIPTION OF THE INVENTION

Figure 1:
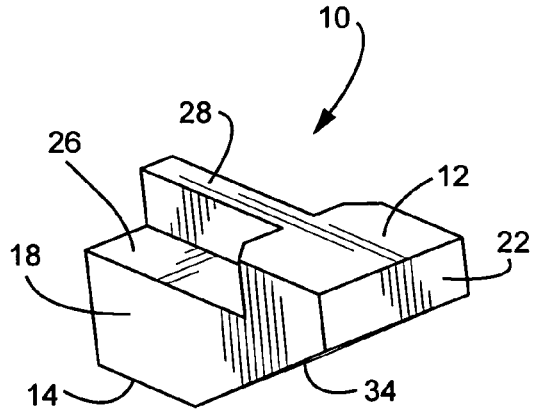
FIG. 1 is a perspective view of a retention key in accordance with the invention.
Figure 2:
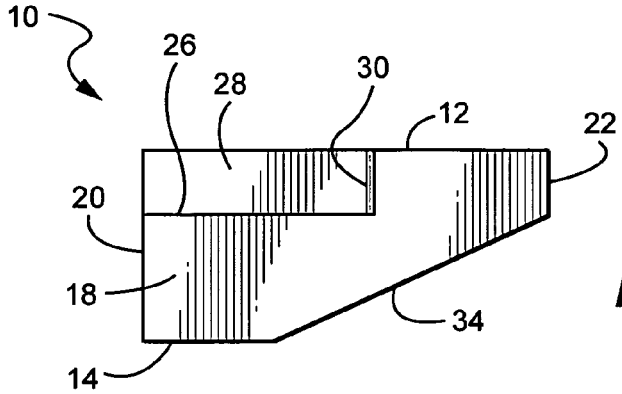
FIG. 2 is a left side elevation view thereof.
Figure 3:
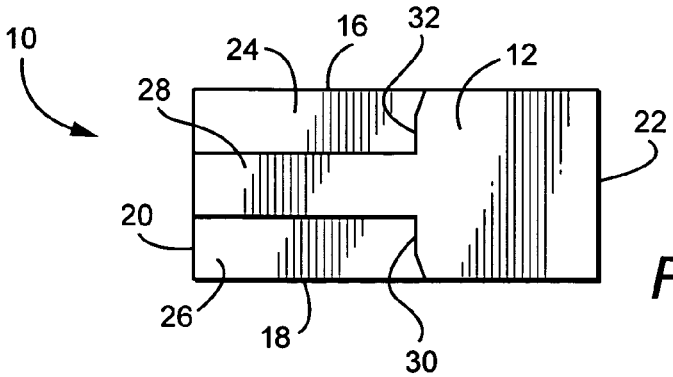
FIG. 3 is a plan view of the retention key shown in FIGS. 1 and 2.
Figure 4:
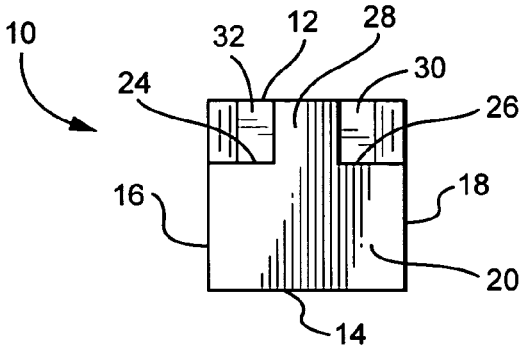
FIG. 4 is a front elevation of the retention key shown in FIG. 2.
Figure 5:
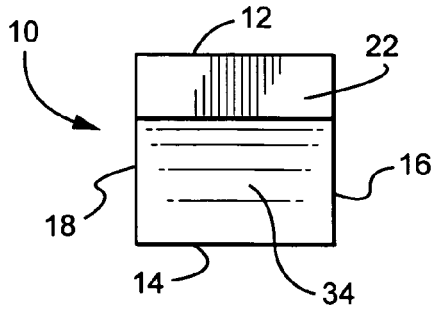
FIG. 5 is a rear elevation of the retention key shown in FIG. 2.

A nozzle retention key 10 in accordance with an exemplary embodiment of the invention is shown in FIGS. 1-5. The key 10 is machined or otherwise formed from a block of suitable metal material (such as a stainless steel alloy) and has, for ease of reference, a top 12, a bottom 14, side walls 16, 18, a forward end or wall 20 and a rearward end or wall 22. The nomenclature is employed given the orientation of the key as shown in FIGS. 1-5 and is not intended to be otherwise limiting. The block is machined or otherwise formed to produce steps or shoulders 24, 26 along sides 16, 18 from the forward end or wall 20 toward but not reaching the rearward end or wall 22. This arrangement leaves a forward center rib 28 flush with top surface 12, with rib 28 extending about or just over half of the length of the key. The center rib 24 terminates at a pair of vertical, forward-facing beveled edges or surfaces 30, 32. This arrangement produces a substantially inverted T-shaped profile at the forward end of the key. The rearward end or wall 22 is truncated by an angled seating surface 34 that extends from rearward wall 22 to the bottom 14, best seen in FIGS. 1 and 2, at an angle of about 25° relative to the bottom 14.

Figure 6:
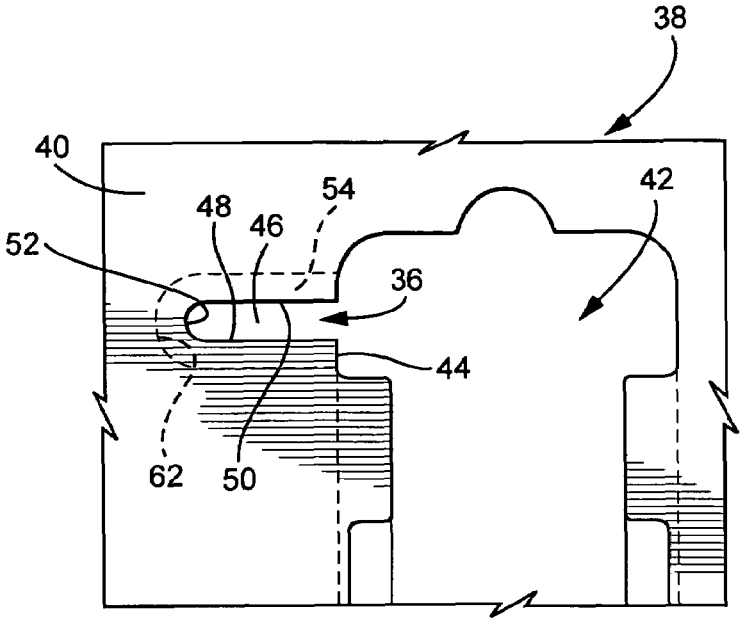
FIG. 6 is a partial plan view of a horizontal joint face of a turbine nozzle carrier, provided with a retention key groove in accordance with the invention.

Turning to FIG. 6, the above-described key is designed to slide into a slot 36 formed in the carrier 38. Specifically, the slot 36 is formed at the horizontal joint face or surface 40 and extends transverse to a conventional dovetail mounting groove 42 that receives the plurality of nozzles as explained further below.

Figure 10:
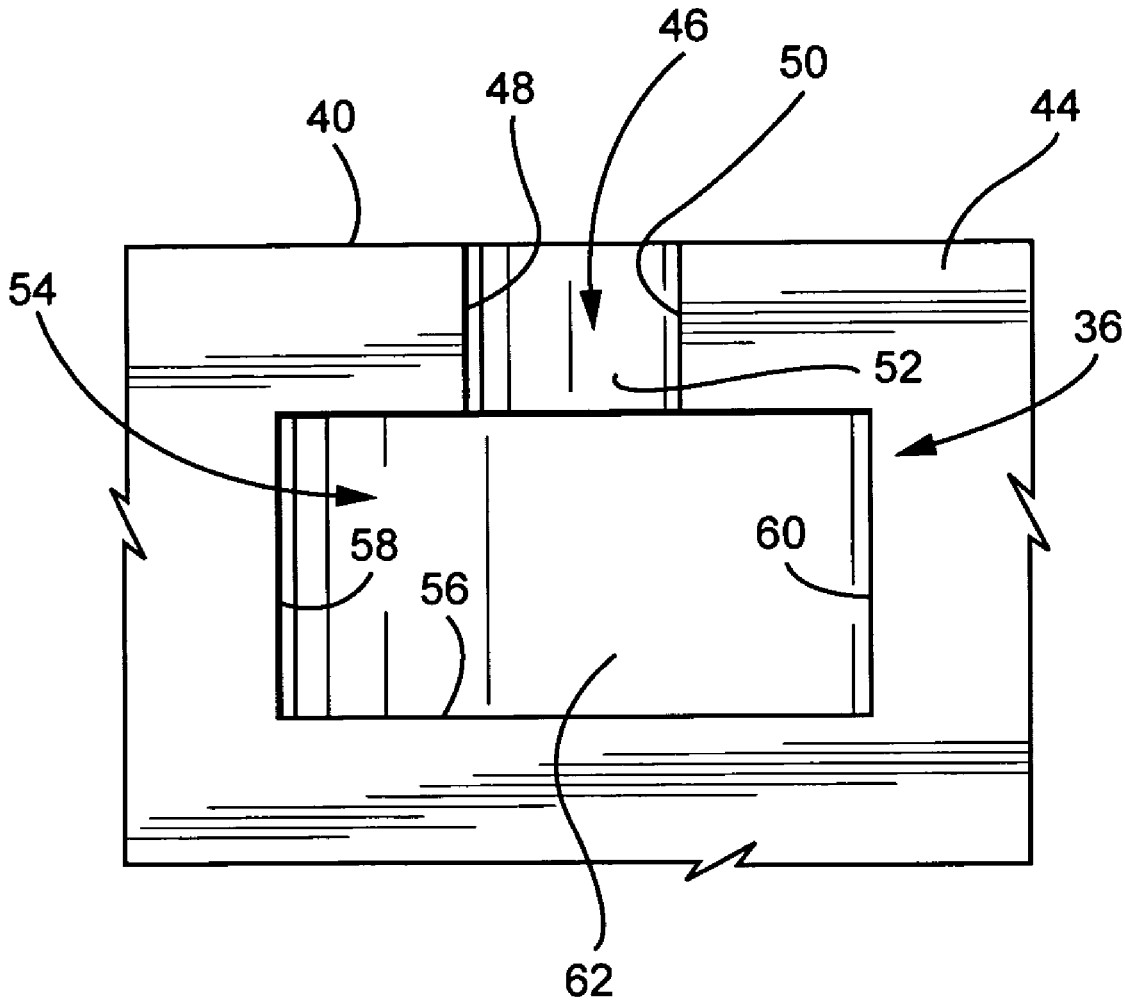
FIG. 10 is a side elevation of the retention key groove formed in the dovetail mounting groove in the turbine nozzle carrier.

Slot 36 opens transversely to the dovetail mounting groove 42, and specifically within the side wall 44 at the base of the groove. The slot 36 is formed with a narrow upper portion 46, open to the joint face 40, including a pair of side walls 48, 50 and a rounded end wall or nose 52. Upper slot portion 46 also opens to the side wall 44 of the groove 42. Slot 36 also includes a lower undercut portion 54 that extends laterally beyond the upper slot portion 46 and longitudinally beyond the end wall or nose 52. The slot bottom 56 is planar, as are lower side wall portions 58, 60 that merge into a rounded forward wall 62 (see FIG. 10).

Figure 7:
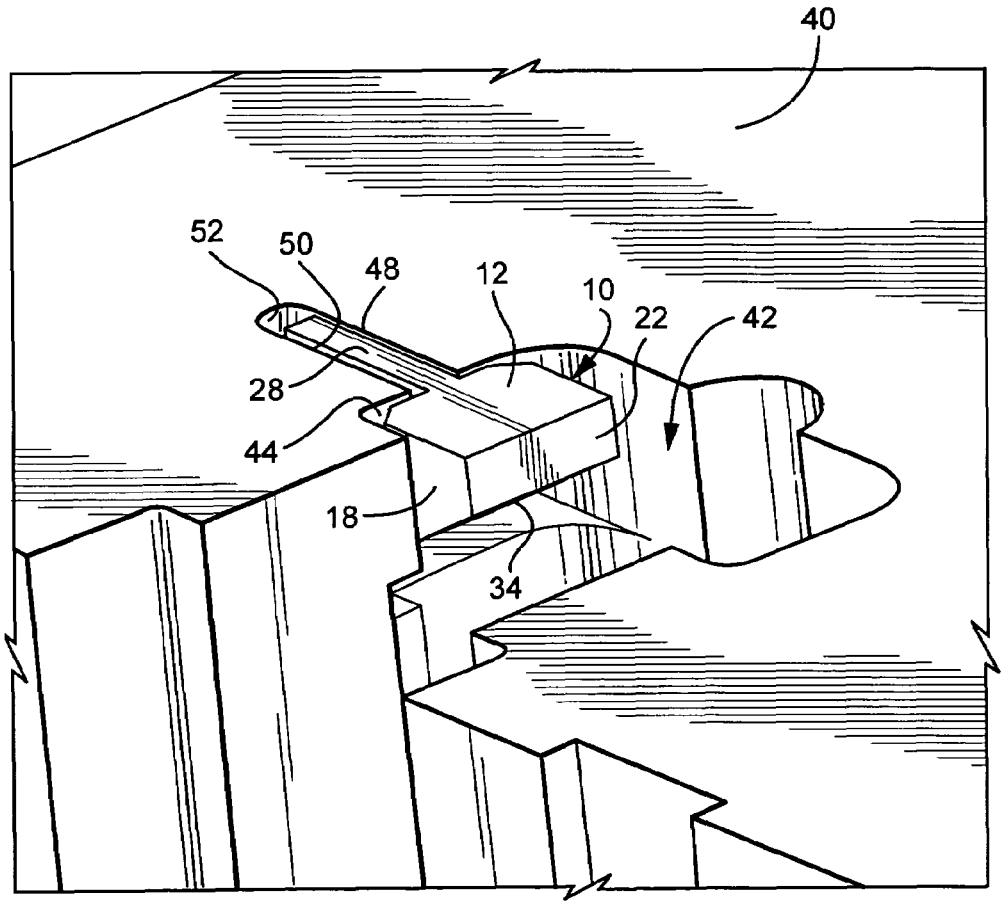
FIG. 7 is a partial perspective view of a carrier with a retention key as shown in FIGS. 1-5 inserted into the retention key slot.
Figure 8:
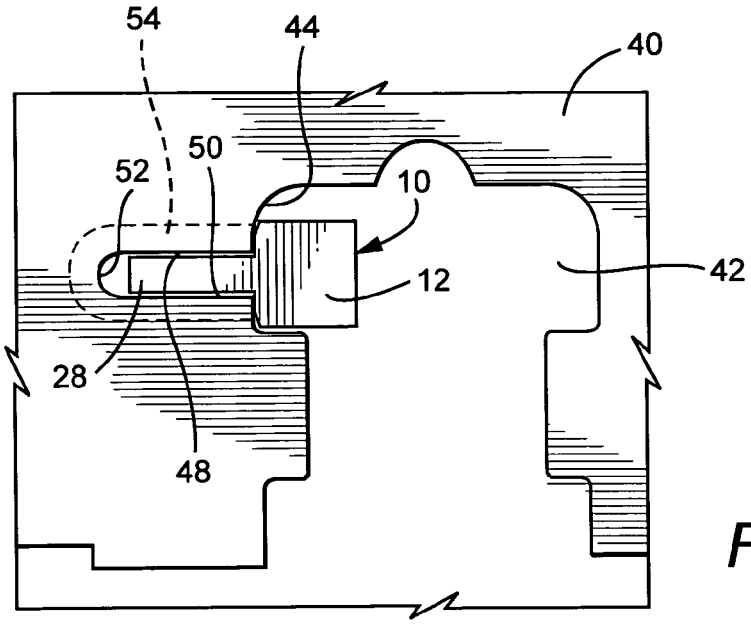
FIG. 8 is a plan view of the assembly shown in FIG. 7.
Figure 9:
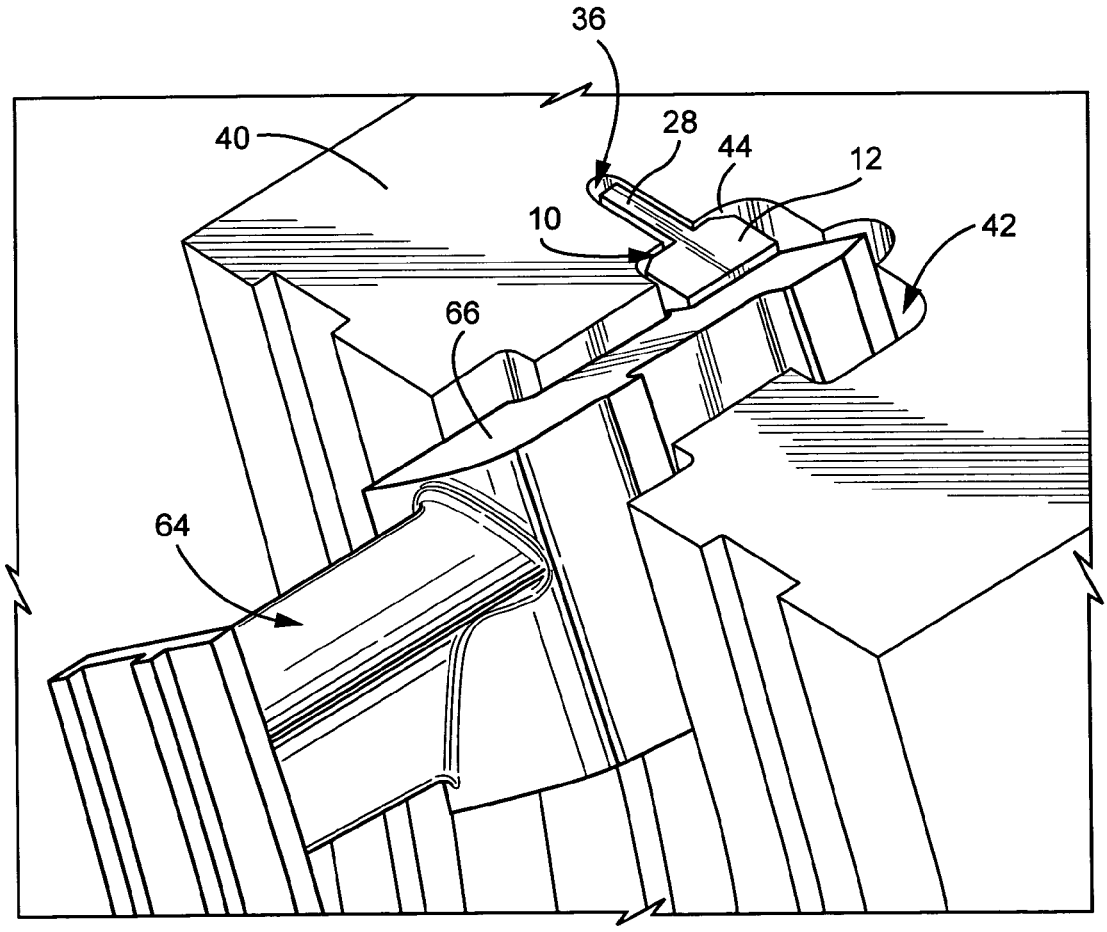
FIG. 9 is a partial perspective of the carrier joint face with the retention key and adjacent nozzle loaded in place.

With particular reference now to FIGS. 7 and 8, the retention key 10 is slidably inserted into the slot 36 until facing surfaces 30, 32 engage the dovetail groove side wall 44. Note that the slot 36 is over-sized to insure clearance between the forward end or wall 20 of the key 10 and the forward walls 52, 62 of the slot. Bottom wall 14 of the key is also seated on the slot bottom 56 insuring that, once inserted, the key will remain in the slot. Turning to FIG. 9, a nozzle 64 can then be slidably moved about the dovetail slot 42 to a location where a sloped nozzle dovetail surface 66 seats against the similarly-shaped surface 34 of the key 10. Key 10 thus insures that nozzle 64 will not escape the slot 42 regardless of the orientation of joint face 40, and also permits additional nozzles to be loaded into the slot 42 from the opposite carrier joint face. At the same time, the interaction between the key and nozzle at opposed surfaces 34 and 66 insures that the key will remain in the slot 36 without separate fasteners. If desired, however, the key may be peened in place to further insure that it will remain stationary once installed.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A retaining key for a turbine nozzle comprising a key body having top and bottom surfaces, a pair of sides and a pair of ends including a forward end having a pair of horizontal shoulders on opposite sides of a center rib, said shoulders located substantially midway between said top and bottom surfaces such that said forward end has a substantially inverted T-shaped profile, and a rearward end having a first surface portion extending from and substantially perpendicular to said top surface and a second surface portion extending at an acute angle downwardly and toward said forward end and intersecting said bottom surface.

2. The retaining key of claim 1 wherein said top surface extends uniformly across said rearward end and said center rib.

3. The retaining key of claim 1 wherein said shoulders terminate in a rearward direction at vertical, forward-facing surfaces on either side of said center rib, extending substantially perpendicular to said top and bottom surfaces.

4. The retaining key of claim 3 wherein said vertical, forward-facing surfaces are beveled where joined to said pair of sides.

5. The retaining key of claim 1 wherein said acute angle is about 25° relative to said bottom surface.

6. The retaining key of claim 1 wherein said key is composed of a stainless steel alloy.

7. A turbine carrier for a steam turbine comprising a pair of 180° arcuate segments, each formed with a semi-annular groove for receiving a plurality of nozzles in side-by-side relationship, each arcuate segment having a pair of horizontally-oriented joint faces, at least one of said joint faces having a key slot formed therein, each key slot formed by a narrow upper portion open to the respective joint face and to said semi-annular groove, and a wider undercut portion below said narrow upper portion open only to said semi-annular groove.

8. The turbine carrier of claim 7 wherein each of said semi-annular grooves comprises a female dovetail groove.

9. The turbine carrier of claim 7 wherein said at least one of said joint faces comprises all of said joint faces.

10. The turbine carrier of claim 7 and further comprising a nozzle retaining key adapted for insertion into said at least one key slot, said retaining key comprising a key body having top and bottom surfaces, a pair of sides and a pair of ends including a forward end having a pair of horizontal shoulders on opposite sides of a center rib, said shoulders located substantially midway between said top and bottom surfaces such that said forward end has a substantially inverted T-shaped profile, and a rearward end having a first surface portion extending from and substantially perpendicular to said top surface and a second surface portion extending at an acute angle downwardly and toward said forward end and intersecting said bottom surface.

11. The turbine carrier of claim 10 wherein said top surface extends uniformly across said rearward end and said center rib.

12. The turbine carrier of claim 10 wherein said shoulders terminate in a rearward direction at vertical, forward-facing surfaces on either side of said center rib, extending substantially perpendicular to said top and bottom surfaces.

13. The turbine carrier of claim 12 wherein said vertical, forward-facing surfaces are beveled where joined to said pair of sides.

14. The turbine carrier of claim 10 wherein said acute angle is about 25° relative to said bottom.

15. The turbine carrier of claim 10 wherein said key is composed of a stainless steel alloy.

16. A turbine carrier for a steam turbine comprising a pair of 180° arcuate segments, each formed with a semi-annular groove for receiving a plurality of nozzles in side-by-side relationship, each arcuate segment having a pair of horizontally-oriented joint faces, at least one of said joint faces having a key slot formed therein, each key slot formed by a narrow upper portion open to the respective joint face and to said semi-annular groove, and a wider undercut portion below said narrow upper portion open only to said semi-annular groove; wherein each of said semi-annular grooves comprises a female dovetail groove; and further comprising a nozzle retaining key adapted for insertion into said at least one key slot, said retaining key comprising a key body having top and bottom surfaces, a pair of sides and a pair of ends including a forward end having a pair of horizontal shoulders on opposite sides of a center rib, said shoulders located substantially midway between said top and bottom surfaces such that said forward end has a substantially inverted T-shaped profile, and a rearward end having a first surface portion extending from and substantially perpendicular to said top surface and a second surface portion extending at an acute angle downwardly and toward said forward end and intersecting said bottom surface; wherein said top surface extends uniformly across said rearward end and said center rib; and further wherein said shoulders terminate in a rearward direction at vertical, forward-facing surfaces on either side of said center rib, extending substantially perpendicular to said top and bottom surfaces.

* * * * *